US006718678B2

(12) United States Patent
Riebling et al.

(10) Patent No.: US 6,718,678 B2
(45) Date of Patent: Apr. 13, 2004

(54) SAFETY DEVICE FOR FIREARMS

(75) Inventors: J. Terry Riebling, Pittsburgh, PA (US); William T. Hughes, Pittsburgh, PA (US); David Koltas, Pittsburgh, PA (US); Bernie Schaub, University Heights, OH (US)

(73) Assignee: Child Guard LLC, Gibsonia, PA (US)

( * ) Notice: Subject to any disclaimer, the term of this patent is extended or adjusted under 35 U.S.C. 154(b) by 0 days.

(21) Appl. No.: 09/927,063

(22) Filed: Aug. 9, 2001

(65) Prior Publication Data

US 2002/0069569 A1 Jun. 13, 2002

Related U.S. Application Data

(63) Continuation-in-part of application No. 09/499,539, filed on Feb. 7, 2000, now Pat. No. 6,601,332.

(51) Int. Cl.[7] ..... F41A 17/00
(52) U.S. Cl. ..... 42/70.07; 42/70.11
(58) Field of Search ..... 42/70.07, 70.11

(56) References Cited

U.S. PATENT DOCUMENTS

| | | | | |
|---|---|---|---|---|
| 3,352,047 A | | 7/1966 | McDonnell | |
| 3,392,471 A | * | 7/1968 | Foote | 42/70.06 |
| 5,191,158 A | * | 3/1993 | Fuller et al. | 42/70.07 |
| 5,283,971 A | | 2/1994 | Fuller et al. | |
| 5,392,552 A | | 2/1995 | McCarthy et al. | |
| 5,400,538 A | * | 3/1995 | Shannon | 42/70.07 |
| 5,515,633 A | | 5/1996 | Harris | |
| 5,544,550 A | | 8/1996 | Stockman | |
| 5,561,935 A | | 10/1996 | McCarthy et al. | |
| 5,638,627 A | | 6/1997 | Klein et al. | |
| 5,647,158 A | | 7/1997 | Eskelinen et al. | |
| 5,704,152 A | * | 1/1998 | Harrison et al. | 42/70.07 |
| 5,713,149 A | | 2/1998 | Cady et al. | |
| 5,720,193 A | | 2/1998 | Dick | |
| 5,832,647 A | | 11/1998 | Ling et al. | |
| 5,899,109 A | | 5/1999 | Ling | |
| 5,910,002 A | | 6/1999 | Hunter | |
| 5,918,402 A | | 7/1999 | Weinraub | |
| 5,918,492 A | | 7/1999 | Klebes | |
| 5,960,575 A | | 10/1999 | Chiovitt et al. | |
| 6,055,759 A | | 5/2000 | Langner | |
| 6,205,695 B1 | | 3/2001 | Schnell | |
| 6,405,469 B1 | * | 6/2002 | Walsh | 42/70.07 |
| 6,457,272 B1 | | 10/2002 | Weinraub | 42/70.07 |
| 6,487,803 B1 | * | 12/2002 | Yu | 42/70.07 |

OTHER PUBLICATIONS

Speedreleasegunlock.com's information sheet regarding Specifications & Features of Speed Release gun lock.
Smarttriggeralarm.com's information sheet regarding Smart Trigger Alarm.

* cited by examiner

*Primary Examiner*—Michael J. Carone
*Assistant Examiner*—M. Thomson
(74) *Attorney, Agent, or Firm*—Fay, Sharpe, Fagan, Minnich & McKee, LLP

(57) ABSTRACT

A firearm safety device for a firearm having a trigger and trigger guard. The firearm safety device includes a first and second assemblies adapted to be secured to the firearm on opposite sides of the trigger guard to prevent access to and actuation of the trigger. A moveable clamp assembly includes slide member having first and second posts for receiving a portion of the trigger guard therebetween is disposed on the first assembly for slidable movement. A fastener is used to secure the slide member to the first assembly in a position to accommodate the trigger guard thereby preventing further sliding movement. Trigger guards having pins received in the apertures can be used to block access to and actuation of the trigger. An alarm is included which sounds when the firearm is moved or when an improper sequence of keys are pressed in an attempt to unlock the device. The alarm preferably sounds continuously during a first time period and intermittently thereafter. The firearm safety device can include a keypad having a single row of keys for quickly unlocking the device. Finger positioning guides can be used to provide tactile references for guiding the fingers into contact with the keys.

12 Claims, 10 Drawing Sheets

SAFETY DEVICE FOR FIREARMS

CROSS REFERENCE TO RELATED APPLICATIONS

This application is a continuation-in-part of U.S. patent application Ser. No. 09/499,539 now U.S. Pat. No. 6,601, 332 filed Feb. 7, 2000 which is hereby incorporated herein by reference.

BACKGROUND OF THE INVENTION

The present invention relates to a safety device for firearms and more specifically a firearm safety device adapted to be secured to a firearm for preventing access to and actuation of the trigger.

Referring to FIG. 1, a known firearm is shown generally at 10. The firearm includes a trigger 12 having a front portion 14 which is actuated or pulled to discharge the firearm 10. A trigger guard 16 extends from the firearm 10 and around the trigger 12 to help prevent unintended actuation of the trigger 12. The trigger guard includes an inside surface 16*a*, an outside surface 16*b*, and opposing side surfaces (one of which is shown as 16*c*). Many firearms have a trigger 12 with a back portion 18 disposed within the trigger guard 16 thereby defining a space 20 behind the trigger 12.

Referring to FIG. 2, a second embodiment of a known firearm is shown generally at 22 having a trigger guard 16. The firearm 22 also includes a trigger 24 having a front portion 26. However, the trigger 24 does not include a back portion disposed within the trigger guard 16 and is therefore referred to as a "solid" trigger. The solid trigger 24 does not have a space defined behind the trigger, although some solid triggers 24 may be perforated by a plurality of holes (not shown) formed through the trigger 24.

Unintended actuation of the trigger 12, 24 by a person handling the firearm 10, 22, and/or unauthorized use by a person, such as a child, present common safety concerns. Firearm safety devices have been developed in an attempt to remedy these concerns. Most known firearm safety devices are attached to the firearm 10, 22 typically to the trigger guard 16 and attempt to block access to or actuation of the trigger 12, 24.

However, for a variety of reasons typical known firearm safety devices do not meet the needs of firearm owners. Many are not adjustable enough to be used on a wide variety of firearms. Many known firearm safety devices can be removed too easily by a person not authorized to use the firearm, while others cannot be removed quickly enough by those who are. Further, many firearm safety devices, even when secured to the firearm, do not adequately prevent discharging the firearm.

Accordingly, it has been considered desirable to develop a new and improved firearm safety device which would overcome the foregoing difficulties and meet the above-stated needs while providing better and more advantageous results.

BRIEF SUMMARY OF THE INVENTION

The present invention relates to a firearm safety device for use in combination with a firearm having a trigger and trigger guard. The firearm safety device includes a first and second assemblies adapted to be secured to the firearm on opposite sides of the trigger guard to prevent access to and actuation of the trigger. One or more lock posts in one of the assemblies engages one or more pawls in the other assembly to secure the firearm safety device to the firearm.

The firearm safety device further includes a moveable clamp assembly. One embodiment includes a slide member having first and second posts disposed in a spaced apart relationship for receiving a portion of the trigger guard therebetween. A fastener is used to secure the slide member to the first or second assembly in a position to accommodate the trigger guard thereby preventing further sliding movement. The slide member may optionally include a plurality of apertures for receiving the second post thereby providing further adjustability. The moveable clamp assembly can include a cam having an eccentric outer surface connected to the first post to further increase the adjustability for different sized trigger guards, thereby accommodating many different firearms.

A plurality of apertures are formed in the first and second assemblies for receiving pins. One embodiment of the firearm safety device includes pins having a first end received in the first assembly apertures and a second end received in the second assembly apertures. One or more pins extend between the first and second assemblies in this manner. Another embodiment includes trigger guards having pins received in the apertures. The plurality of apertures allow the trigger guards to be positioned such that they are disposed adjacent the trigger for blocking access to and preventing actuation of a solid trigger.

A lip is disposed on the periphery of one of the first or second assemblies for overlapping with the other of the first and second assemblies such that the periphery of the assemblies overlap when secured to the firearm. The overlap prevents prying the assemblies apart when mounted to the firearm.

A third embodiment of the firearm safety device includes an electronic keypad and an electric motor for locking and unlocking the first and second assembly. An alarm is included which sounds when the firearm is moved or upon the conclusion of a countdown initiated by an attempt to unlock the device. The alarm preferably sounds continuously during a first time period, is silent during a second time period and then sounds during a third time period which is shorter than the first time period. The second and third time periods are repeated so that the alarm sounds intermittently after sounding during the first time period.

The firearm safety device can include a keypad having a single row of keys for quickly unlocking the device. Finger positioning guides can be used to provide tactile references for guiding the fingers into contact with the keys assisting the removal of the device without visual cues.

Still other benefits and advantages of the present invention will become apparent to those skilled in the art upon a reading and understanding of the following detailed specification.

BRIEF DESCRIPTION OF THE DRAWINGS

The invention may take form in certain parts and arrangements of parts, embodiments of which will be described in detail in this specification and illustrated in the accompanying drawings which form a part hereof and wherein.

DETAILED DESCRIPTION OF THE INVENTION

It is to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting. It should be appreciated that the invention can be used for any suitable firearm 10, 22 having a trigger 12, 24 and trigger guard 16 including, but not limited to, pistols, revolvers, rifles, shotguns, carbines, etc.

Figure 1:
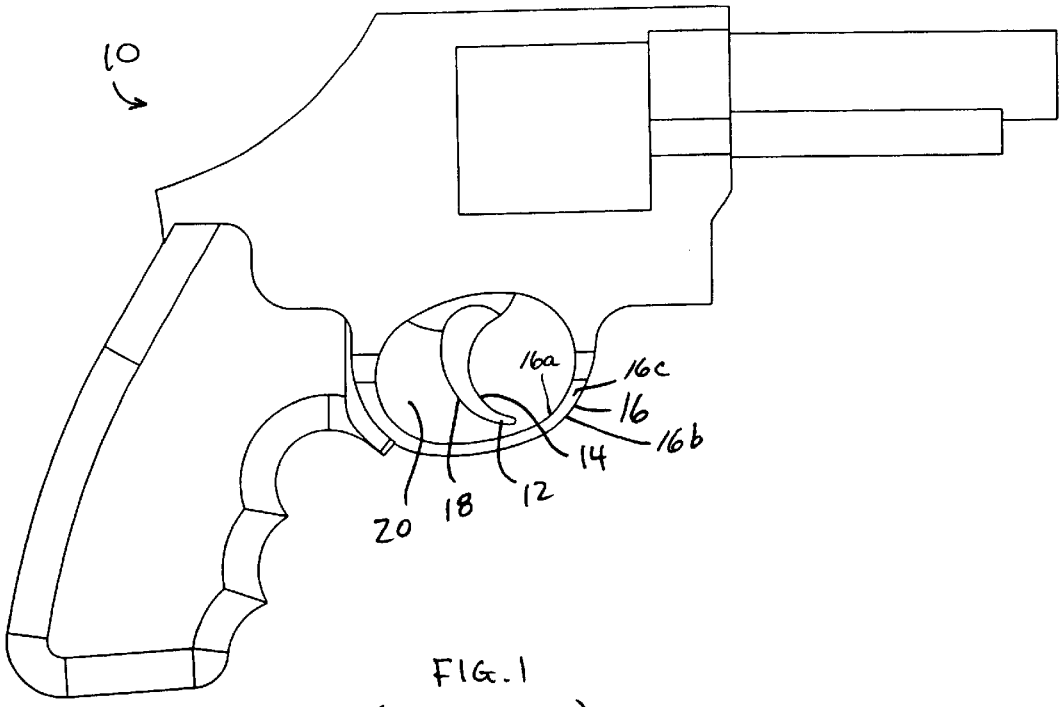
FIG. 1 (PRIOR ART)
FIG. 1 is a side view of a known firearm.
Figure 2:
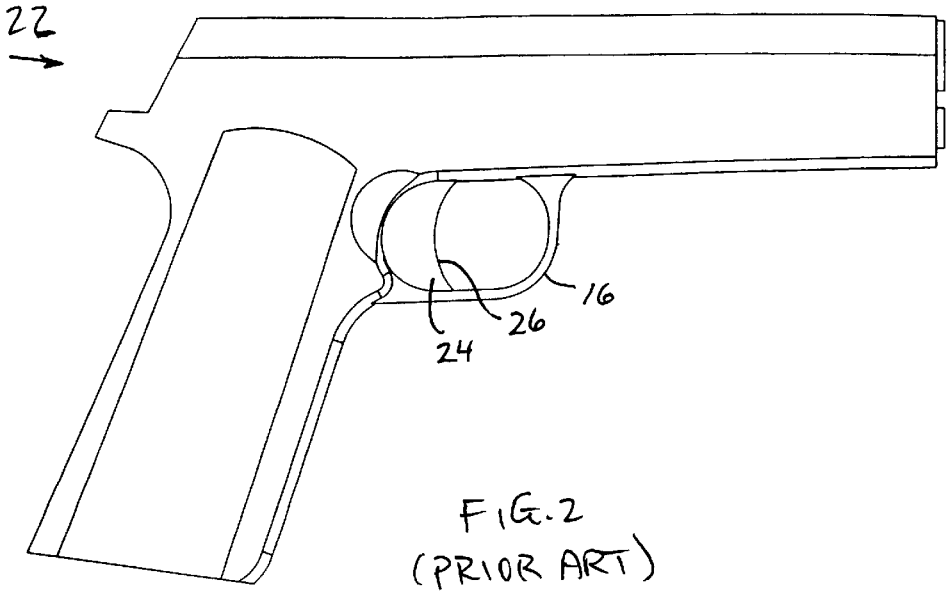
FIG. 2 (PRIOR ART)
FIG. 2 is a side view of a known firearm having a solid trigger.
Figure 3:
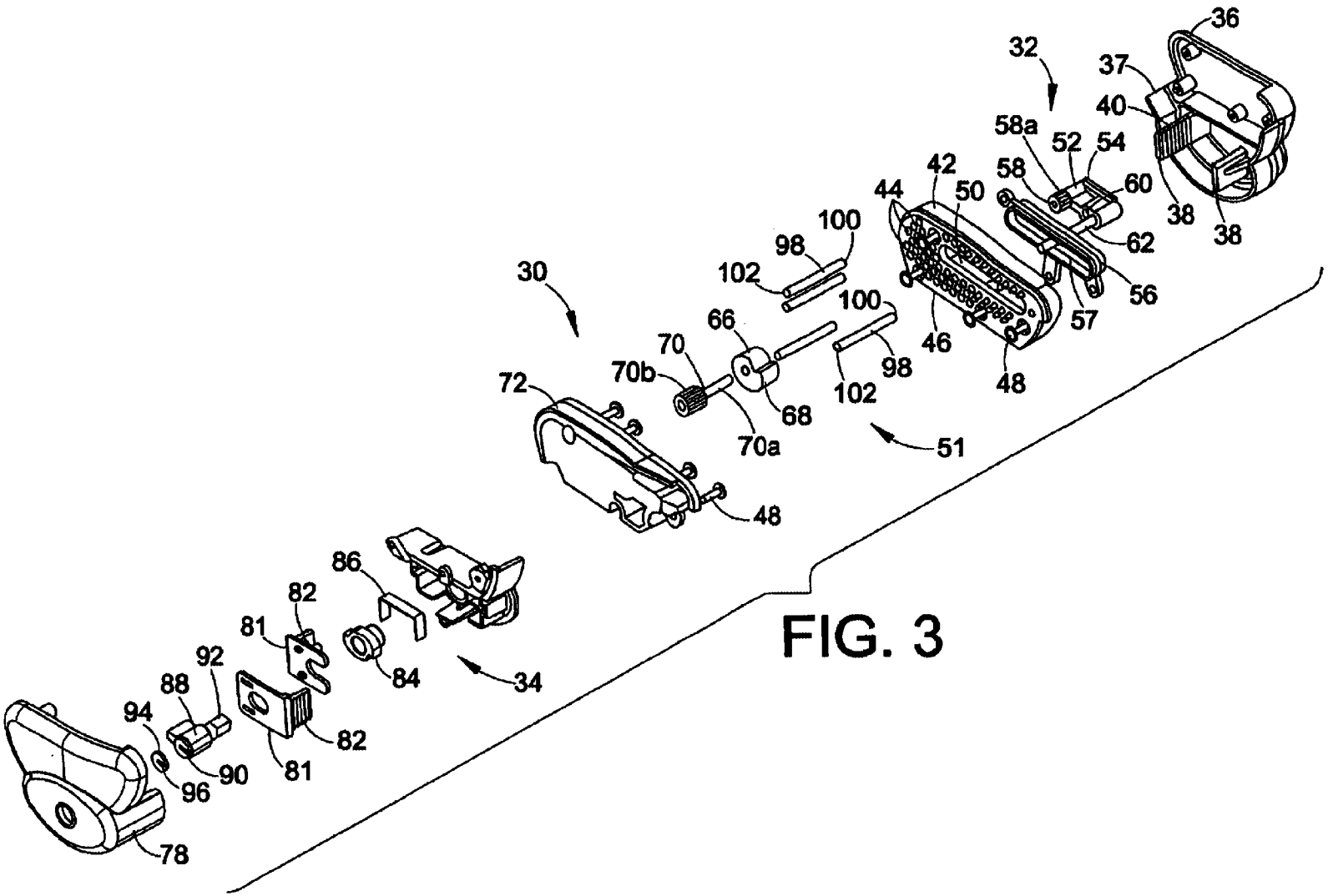
FIG. 3 is an exploded view of a firearm safety device in accordance with the invention.
Figure 4:
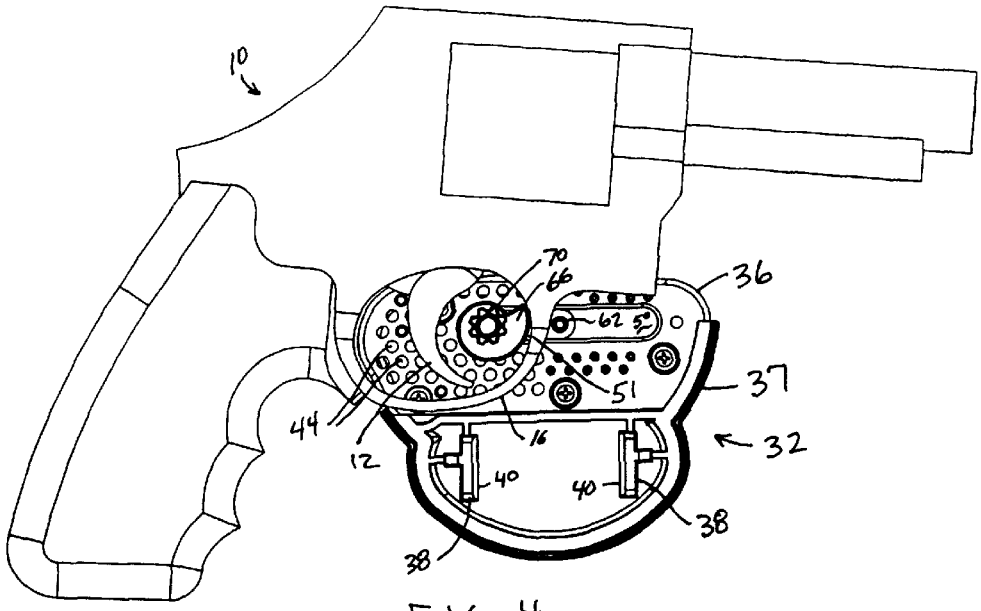
FIG. 4 is a side view of a first assembly attached to the fire arm in accordance with the invention.
Figure 5:
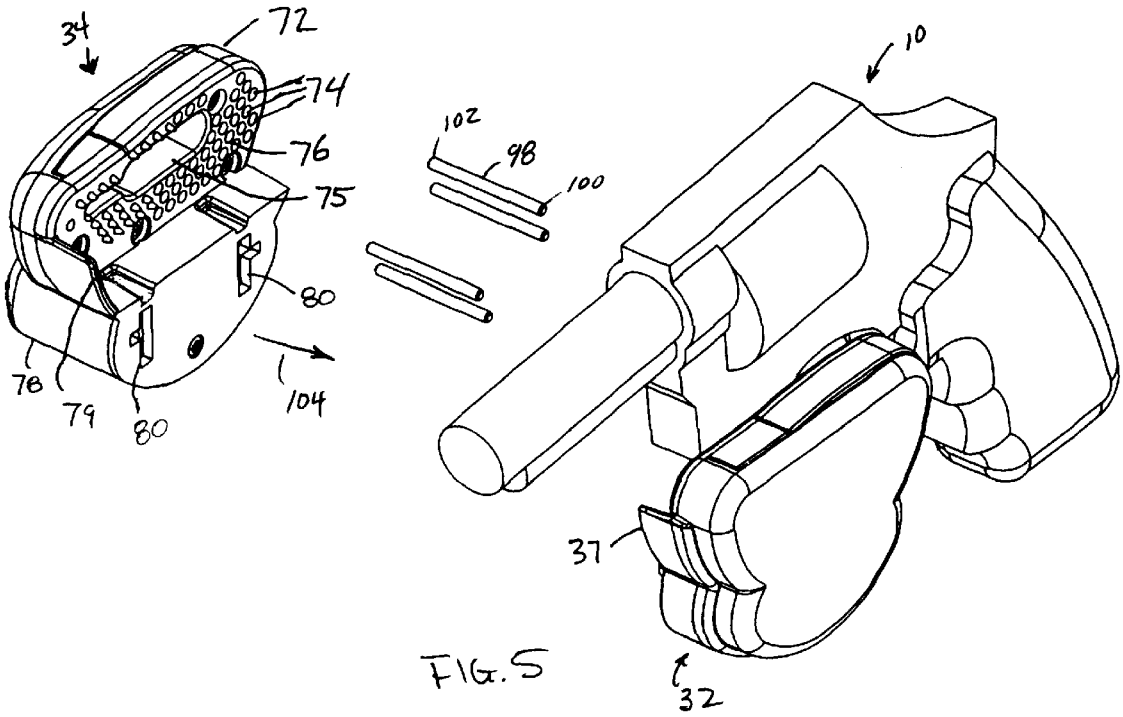
FIG. 5 is a perspective view of the second assembly being secured to the firearm in accordance with the invention.

Referring now to FIGS. 3–5, a firearm safety device in accordance with the invention is shown generally at 30. The firearm safety device 30 includes a first assembly 32 and second assembly 34 adapted to be secured together adjacent opposite sides of the firearm trigger guard 16 as shall be described in further detail below. The first assembly 32 includes a housing 36 having a pair of toothed members, or lock posts 38 extending therefrom in a space apart relationship. The lock posts 38 each include teeth 40 formed thereon. The housing 36 includes a lip 37 to be described in further detail below.

The first assembly 32 further includes a first portion 42 having a plurality of apertures 44 formed therein. The first portion 42 includes an abutment surface 46 for abutting the firearm when the safety device 30 is secured to the firearm 10, 22. The abutment surface 46 is preferably formed of a compliant material, such as rubber or any other suitable compliant material for preventing nicks, scratches or any other damage to the firearm 10, 22. The first portion 42 is attached to the housing 36 with fasteners 48 or in any other suitable known manner, although alternatively, it may be formed integrally with the housing 36. The first portion 42 also includes a slot 50 formed in the abutment surface 46.

The first assembly 32 further includes a moveable clamp assembly 51 which can be moved to different locations on the first assembly 32 to accommodate firearms having trigger guards of different sizes and configurations thereby providing a great degree of flexibility. The clamp assembly 51 includes a slide member 52 disposed in the slot 50 for slidable movement relative to the first assembly 32. The slide member 52 can be retained to the first assembly 32 for slidable movement within the slot 50 by any suitable known manner. By way of an example which should not be considered limiting, the slide member 52 may include a flange 54 which is captured between the first portion 42 and the housing 36 thereby retaining the slide member 52 within the slot 50 and preventing rotation of the slide member relative to the first assembly yet allowing the slidable movement. An optional rigid track member 56 having a slot 57 may also be secured to the housing 36 to capture the slide member flange 54 therebetween.

The slide member 52 includes a first post 58 extending therefrom and through the slot 50, and one or more apertures 60 for receiving a second post 62 which also extends from the slide member 52 through the slot 50. Alternatively, the second post 62 may be fixed to the slide member rather than being received in the one or more apertures 60.

The first post 58 includes a cam 66 having an eccentric outer surface 68. The diameter of the cam 66 is preferably larger than the width of the slot 50. The first post 58 can include a keyed portion 58*a*. The cam 66 can include an aperture having a shape which is complementary to the keyed portion 58*a* for receiving the keyed portion 58*a* to prevent rotation of the cam 68 relative to said slide member 52 and the first assembly.

A fastener 70 is provided to secure the slide member 52 to the first assembly 32. The faster may be any suitable known fastener, such as a bolt 70. The bolt 70 preferably extends through the cam 68 and the first post 58. The bolt includes a threaded end 70*a* received in the slide member and a head 70*b* for abutting the cam 68.

Referring now to FIGS. 3 and 5, the second assembly 34 includes a first portion 72 having a plurality of apertures 74 formed therei. A slot 75 is formed in the first portion 72 for receiving the first 58 and second 62 posts extending from the slide member 52 when the first 32 and second 34 assemblies are joined together. The first portion 72 also includes an abutment surface 76 preferably formed of a compliant material similar to the first portion abutment surface 46 described above.

The second assembly 34 also includes a housing 78 attached to the first portion 72 with fasteners 48 or in any other suitable known manner. The housing 78 includes a lip 79 which shall be described in further detail below. The housing further includes a pair of apertures 80 for receiving the lock posts 38 as shall be described below. A pair of lock posts such as pawls 81 having teeth 82 are disposed within the housing 78. A cam 84 is disposed between the pawls 81. A spring 86 can be disposed between the pawls 81 for biasing the pawls 81 towards each other and the cam 84.

The second assembly 34 further includes a lock 88 having a key aperture 90 for receiving a key (not shown) for locking and unlocking the lock 88 in a known manner. The lock 88 further includes a keyed post 92 extending into the cam 84 which moves the cam 84 when the key is inserted into the key aperture 90 and turned. Therefore, when the first 32 and second 34 assemblies are disposed adjacent the trigger guard 16, turning the key rotates the post 92 and the cam 84 which moves the pawls 81 between a first and second position. The first position being a locked position in which the teeth 82 of the pawls mesh with the teeth 40 of the lock posts 38 of the first assembly 32 to secure the first 32 and second 34 assemblies together on the firearm 10. The second position being an unlocked position in which the pawl teeth 82 do not mesh with the teeth of the lock posts 38 so that the first 32 and second 34 assemblies can be separated from each other and the firearm 10.

A washer 94 having an elongated key aperture 96 is disposed over the lock key aperture 90. The washer 94 is held in place over the key aperture in a known manner, such as by the housing 78, so that it can rotate. The rotatable washer 94 allows the elongated key aperture 96 to be aligned with the lock key aperture 90 for insertion of the key. Furthermore, the rotatable washer 94 hinders a person from drilling out the lock 88 because it rotates with the turning drill bit.

The firearm safety device 30 further includes one or more pins 98 each having a first end 100 adapted to be received in the apertures 44 formed in the first portion 42 of the first assembly 32 and a second end 102 adapted to be received in the apertures 74 formed in the first portion 72 of the second assembly 34 as shall be described below.

Figure 11:
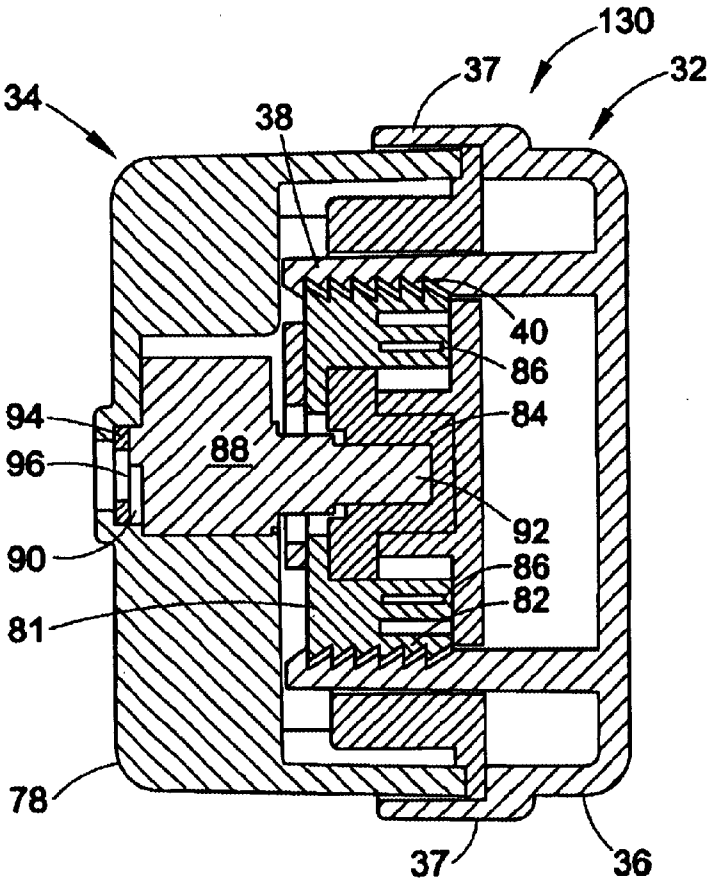
FIG. 11 is a sectional top view of the firearm safety device in accordance with the invention.

Referring to FIGS. 4, 5 and 11 the operation of the firearm safety device 30 and the manner of securing it to a firearm 10 having a trigger 12 shall now be described. The first assembly 32 is positioned near the trigger guard 16 so that the abutment surface 46 of the first portion 42 is disposed adjacent to a first side 16*c* of the trigger guard 16.

The clamp assembly 51 is then moved to a position on the first assembly 32 to capture a portion of the trigger guard 16. The slide member 52 is slid along the slot 50 into a position such that the second post 62 abuts the outside surface of the trigger guard 16. As described above, the slide member 52 may include a plurality of apertures 60 for receiving the second post 62 to provide greater adjustability for the location of the second post 62 relative to the first post 58.

Next, the cam 66 is placed over the first post 58 so that the outer cam surface 68 is adjacent, and preferably abuts the inside 16*a* of the trigger guard 16 as shown in FIG. 4. The cam is pushed down onto the first post 58 so that the trigger guard 16 is received between the first 58 and second 62 posts. The optional keyed fit between the first post 58 and cam 66 prevents the cam 66 from rotating.

The slide member 52 is then fixed to the first assembly 32 to prevent further sliding movement of the slide member 52. This can be accomplished in any known manner using any known fastener. For example, the bolt 70 is inserted through the cam 68 and the threaded end 70*a* is screwed into the slide member 52 and tightened until the head 70*b* presses the cam 66 against the first portion 42 thereby fixing said slide member 52 to said first assembly 34 preventing further sliding movement.

Next the first ends 100 of one or more pins 98 are inserted into the apertures 44 in the first portion 42. The pins 98 are preferably inserted into the space 20 behind the trigger 12, although the pins 98 may be used in any of the apertures. Additional pins 98 may be inserted in apertures 44 located at other positions as well.

The lock 88 is unlocked. The second assembly 34 is then positioned near the trigger guard 16 so that the abutment surface 76 of the first portion 72 is disposed adjacent to a second side of the trigger guard 16, opposite the first side, and the second ends 102 of the pins 98 are received in the apertures 74 in the first portion 72 of the second assembly 34. The first 58 and second 62 posts extending from the slide member 52 are received into the second assembly slot 75.

As the second assembly 34 is moved towards the first assembly 32, as shown by the arrow 104 in FIG. 5, the pair of lock posts 38 extending from the first assembly 32 are preferably received in the apertures 80 in the second assembly 34 and positioned adjacent the pawls 81. Next, the lock 88 is locked with the key moving the pawl teeth 82 into engagement with the lock post teeth 40 thereby securing the first 32 and second 34 assemblies together against opposite sides of the trigger guard 16. The pair of lock posts 38, which are received between the pawls 81 and the second assembly housing 78, prevent the first 32 and second 34 assemblies from being twisted apart providing much more security than a single lock post.

Alternatively, the spring 86 and the shape of the teeth 40, 82 may allow the second assembly 34 to be secured to the first assembly 32 with the lock 88 locked. When the first 32 and second 34 assemblies are brought together in this condition, the cam 84 is positioned to move the pawls 81 outwards and the pawl teeth 82 into meshing engagement with the lock post teeth 40. As the first and second assemblies are pushed together, the shape of the teeth 40, 82 allow them to ratchet past each other providing a tighter grip formed between the firearm safety device 30 and the trigger guard 16. The teeth 40, 82 are shaped to grip each other tightly when locked together and forces are applied attempting to pull the first 32 and second 34 assemblies apart.

The pins 98 which now extend between the locked first 32 and second 34 assemblies, behind the trigger 12, prevent movement of the firearm safety device relative 30 to the firearm 10, either relative rotational movement or movement in a forward/backward direction. The pins 98, being disposed behind the trigger 12, also help to prevent actuation of the trigger.

Figure 6:
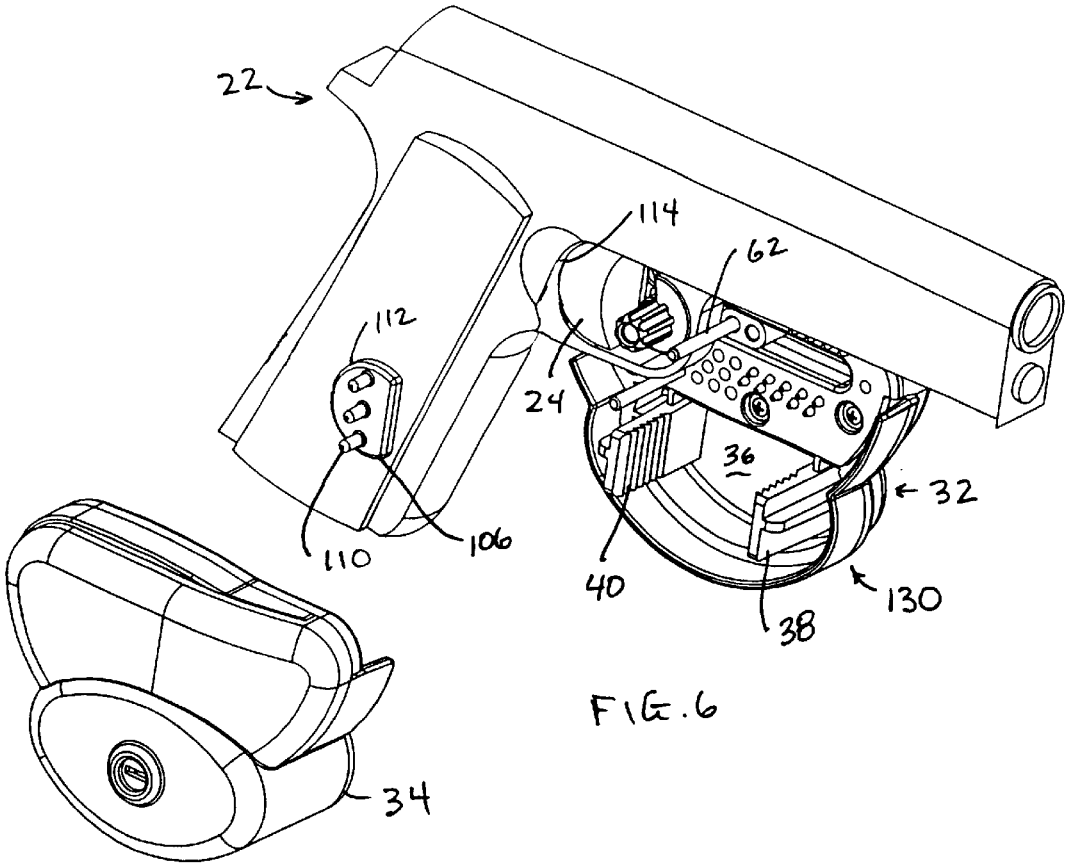
FIG. 6 is a perspective view of an alternate embodiment of the firearm safety device in accordance with the invention.
Figure 7:
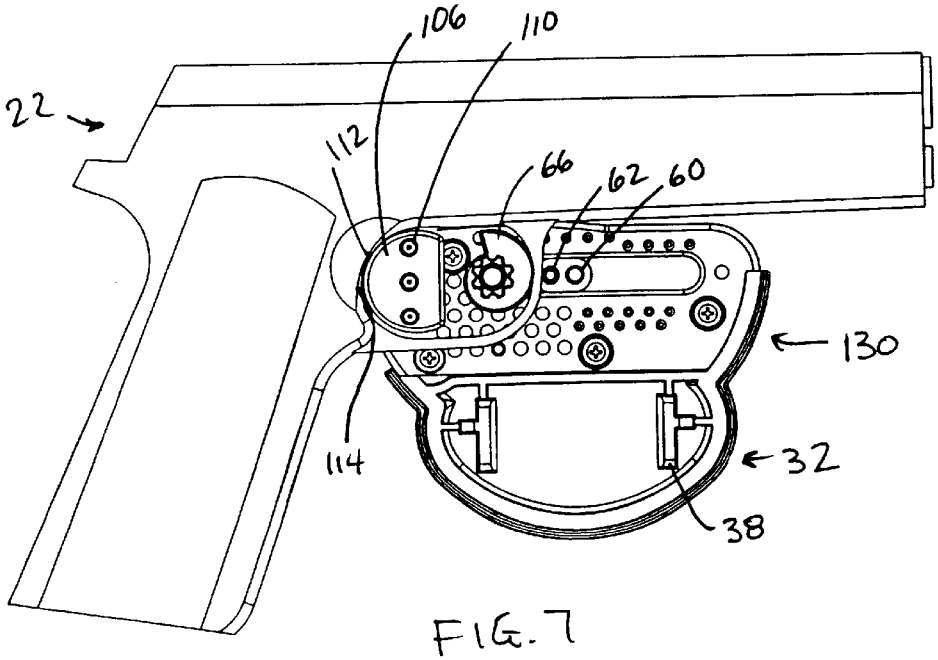
FIG. 7 is a side view of a first assembly of the alternate embodiment attached to the fire arm in accordance with the invention.
Figure 10:
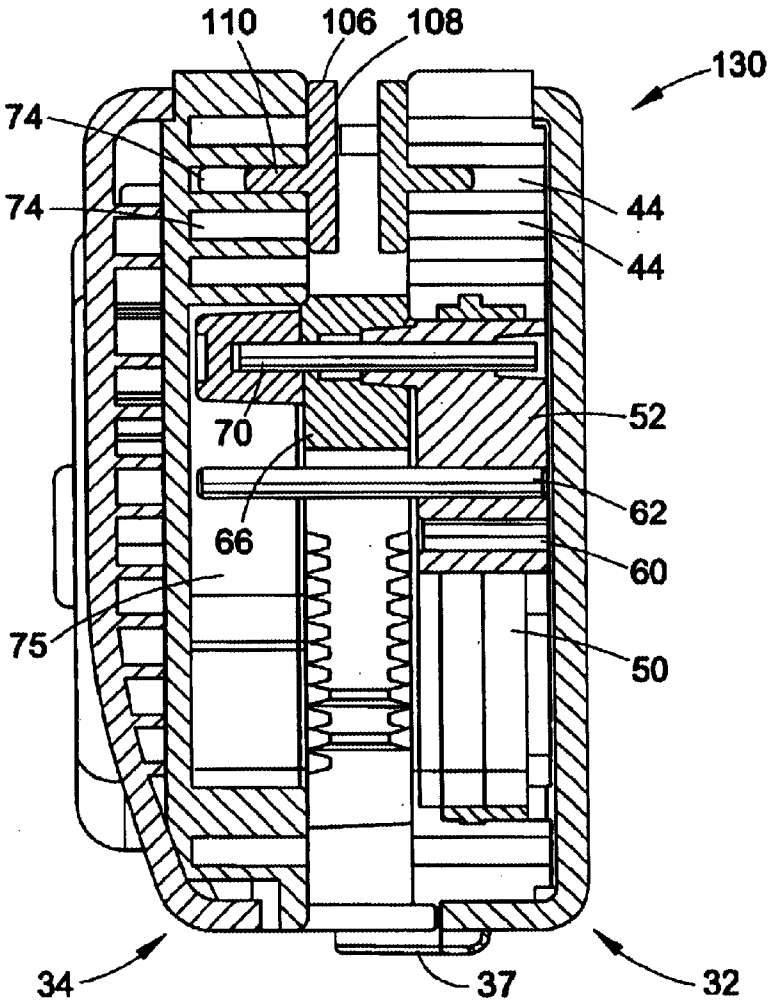
FIG. 10 is a sectional top view of the firearm safety device in accordance with the invention.
Figure 12:
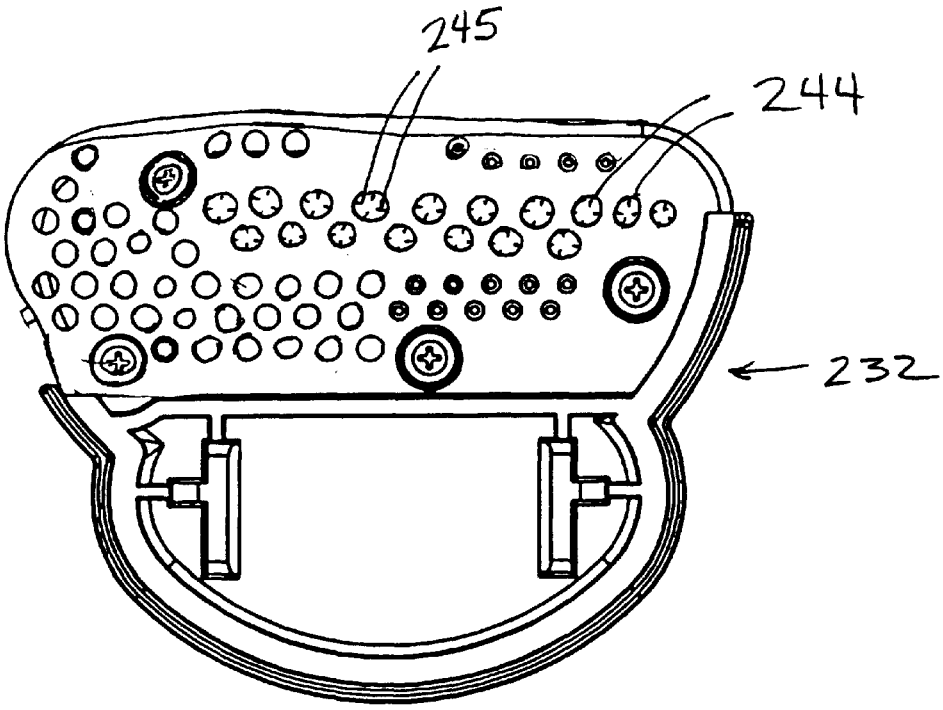
FIG. 12 is a side view of a first assembly of a second alternate embodiment of the firearm safety device in accordance with the invention.
Figure 13:
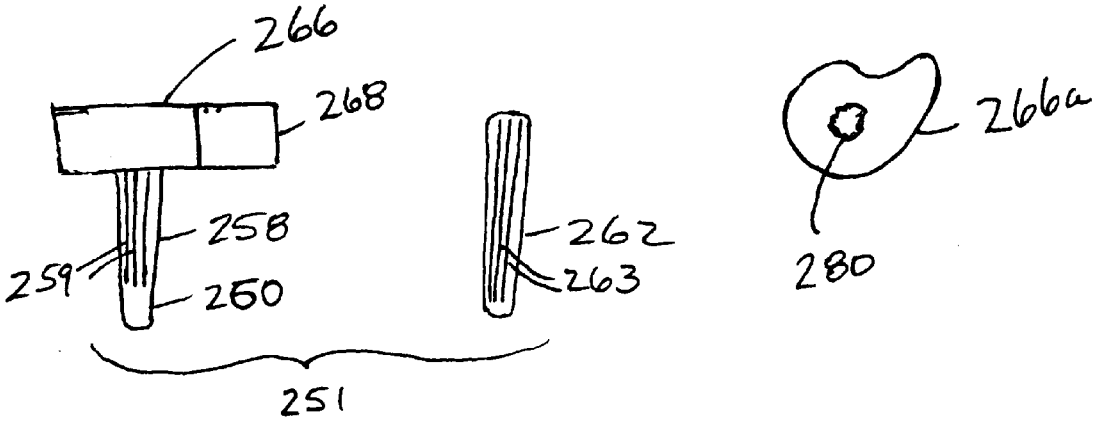
FIG. 13 is a side view of the cam and posts in accordance with the second alternate embodiment of the invention.
Figure 14:
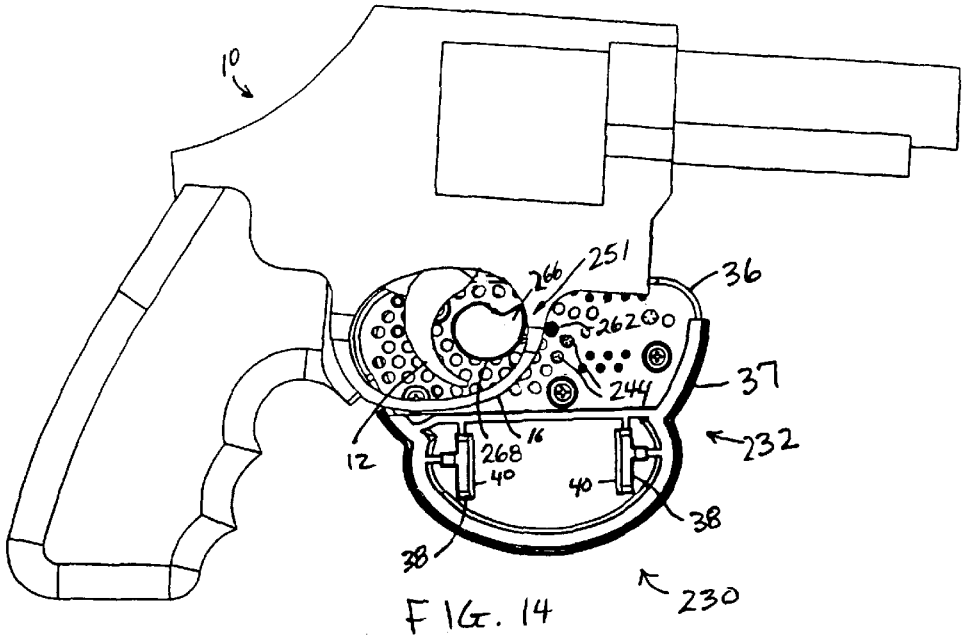
FIG. 14 is a side view of the assembly shown in FIG. 12 attached to the firearm in accordance with the invention.
Figure 15:
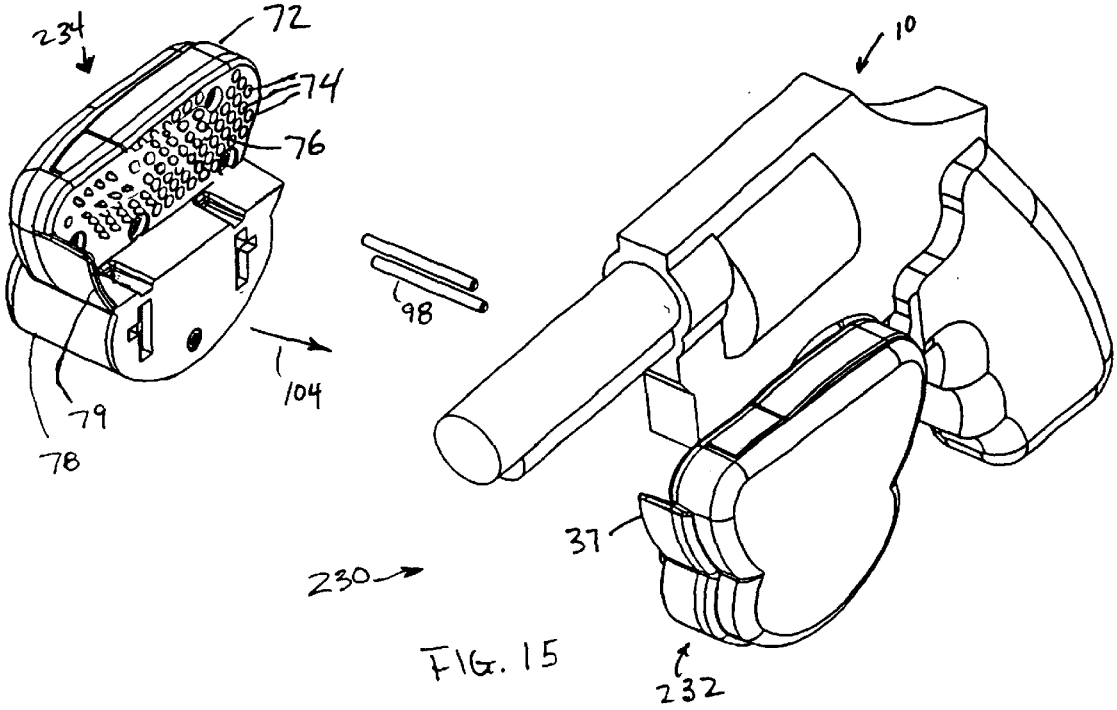
FIG. 15 is a perspective view of the second alternate embodiment showing the second assembly being attached to the firearm in accordance with the invention.

Referring now to FIGS. 6, 7 and 10, an alternate embodiment of the firearm safety device is shown generally at 130 for use with a firearm 22 having a solid trigger 24 described above. The firearm safety device 130 is similar to the firearm safety device 30 described above, with like components numbered using the same reference numerals, except that a pair of trigger plates 106 are used instead of the pins 98.

The trigger plates 106 include a first surface 108 (shown in FIG. 10) and one or more pins 110 extending from the side opposite the first surface 108. The pins 110 of one trigger plate 106 are received into the apertures 44 of the first assembly 32 while the pins 110 of the other trigger plate 106 are received into the apertures 74 of the second assembly 34. The trigger plates 106 are positioned by placing the pins 110 into the proper apertures 44, 74 so that the trigger plates 106 are disposed adjacent each side of the solid trigger 24 when the first and second assemblies are connected together. Preferably, the first surfaces 108 abut opposite sides of the trigger 24 when the firearm safety device 130 is secured to the firearm 22, although alternatively, the first surfaces may be disposed slightly spaced apart from the trigger 24.

The trigger plates 106 each have an edge surface 112 having a shape which is complementary to the shape of the surface of the firearm frame 114 adjacent and just behind the trigger 24 (shown in FIG. 6). When the firearm safety device 130 is secured to the firearm 22, the trigger plates 106 are positioned so that the edge surfaces 112 abut the complementary shaped surfaces 114 on the frame of the firearm 22. The fit of the edge surfaces 112 against the complementary shaped frame surfaces 114 prevent movement of the firearm safety device 130 relative to the firearm 22, including rotational movement.

Figure 8:
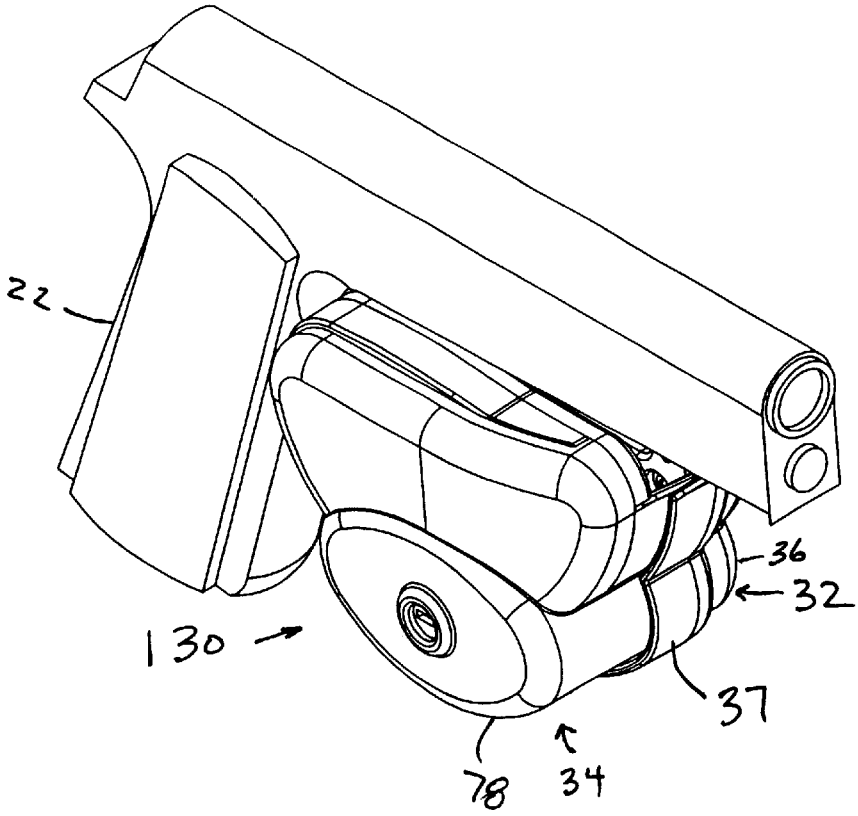
FIG. 8 is a perspective view of the firearm safety device secured to a firearm in accordance with the invention.
Figure 9:
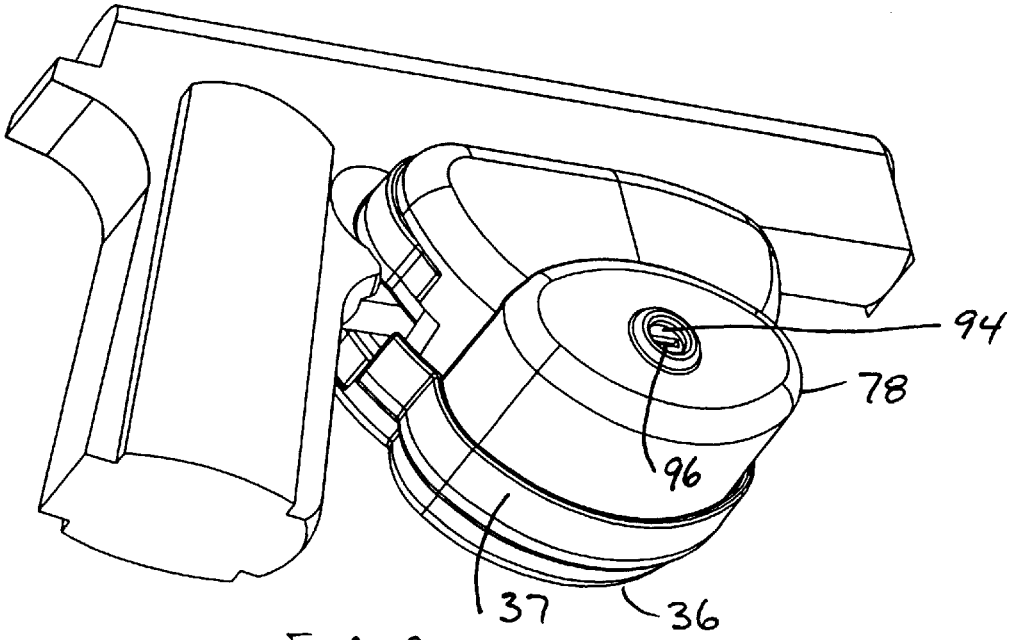
FIG. 9 is a perspective view of the firearm safety device secured to a firearm in accordance with the invention.

Referring now to FIGS. 8–10, the firearm safety device 130 is shown secured to the firearm 22. As described above, the first assembly housing 36 includes a lip 37 extending therefrom. The lip 37 preferably extends around the entire perimeter of the housing 36 except where the first assembly 32 abuts the trigger guard 16 or the firearm 10. The periphery of the first 32 and second 34 assemblies overlap each other, except where the trigger guard 16 or firearm 10 is disposed therebetween, when the assemblies are secured together on the firearm 22. Preferably, the first assembly lip 37 overlaps the second assembly housing 78. The overlap of the first 32 and second 34 assemblies prevents access to the internal components of the safety device as well as access to the firearm trigger and helps prevent the assemblies from being pried apart. Alternatively, the second assembly 34 may include a lip 79 which overlaps the first assembly 32, or both assemblies 32, 34 may include overlapping lips.

Referring now to FIGS. 12–15, a second alternate embodiment of the firearm safety device is shown generally at 230. The firearm safety device 230 includes first 232 and second 234 assemblies similar to those described above with similar components having the same reference numerals. In place of the slide member 52, the first assembly includes a plurality of apertures 244.

The firearm safety device includes a moveable clamp assembly 251 which can be moved to different locations on the first assembly 232. The clamp assembly 251 includes a cam 266 having an eccentric outer surface 268 similar to the outer surface 68 of the cam 66 described above. A first post 258 extends from the cam 266. The post 258 preferably includes splines 259 extending lengthwise on the outer surface, and an unsplined tip 260. The clamp assembly 251 further includes a second post 262 which can also include splines 263 extending lengthwise on the outer surface thereof.

The first and second posts are adapted to be received in the plurality of apertures 244. The plurality of apertures 244 can also include grooves 245 extending lengthwise along the walls of the apertures for cooperating with the post splines 258 and 262 thereby preventing the posts from rotating for the purpose described below. Alternatively, the cam 266*a* includes a hole 280 keyed to a post 262 so that the cam will not rotate after it is placed onto the post in a similar manner as described above.

The firearm safety device 230 is secured to the firearm 10 by positioning the first assembly 232 near the trigger guard 16 so that the abutment surface 46 of the first portion 42 is disposed adjacent to a first side 16*c* of the trigger guard 16. The clamp assembly 251 is then moved to a position on the first assembly 232 and fixed thereto to capture a portion of the trigger guard 16. The second post 262 is inserted into one of the apertures 244 adjacent the outside surface 16*b* of the trigger guard 16.

Next, the cam 266 is positioned near the inside surface 16*a* of the trigger guard 16 by inserting the tip 260 of first post 258 into an appropriate aperture 244. The unsplined tip enables the cam to be rotated until the cam's outer surface 268 abuts the trigger guard inside surface 16*a* at which point the cam 266 is pressed against the first assembly 232 pushing the splined post 258 the rest of the way into the aperture 244. The splines 259 cooperate with the grooves 245 to prevent the cam 266 from rotating thereby retaining the position of the cam with respect to the first assembly 232 and the trigger guard 16. Alternatively, a small space may exist between the outer surface 268 and the trigger guard.

Capturing the trigger guard 16 with the clamp assembly 251 in this manner prevents movement of the firearm safety device 230 relative to the firearm when the first 232 and second 234 assemblies are secured together on each side of the trigger guard 16. The second assembly 234 is joined to the first assembly 232 in a manner similar to that described above including using trigger plates 106 or using pins 98 inserted behind the trigger.

Figure 16:
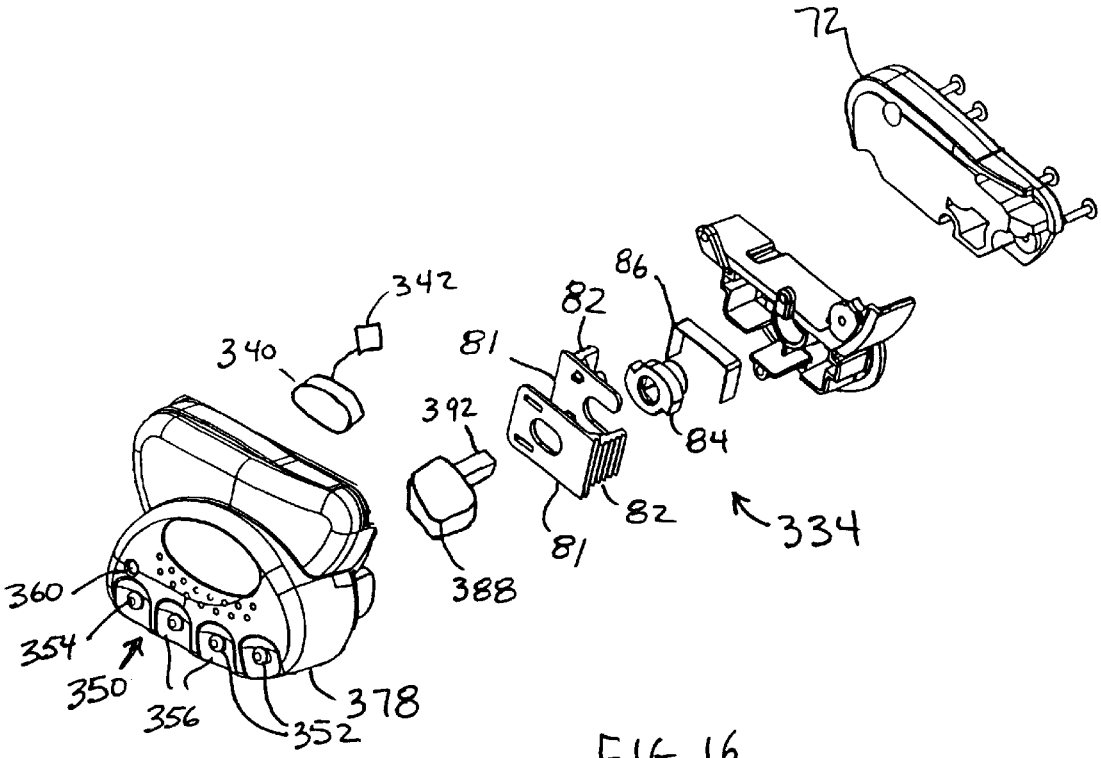
FIG. 16 is an exploded view of the first assembly of a third alternate embodiment in accordance with the invention.
Figure 17:
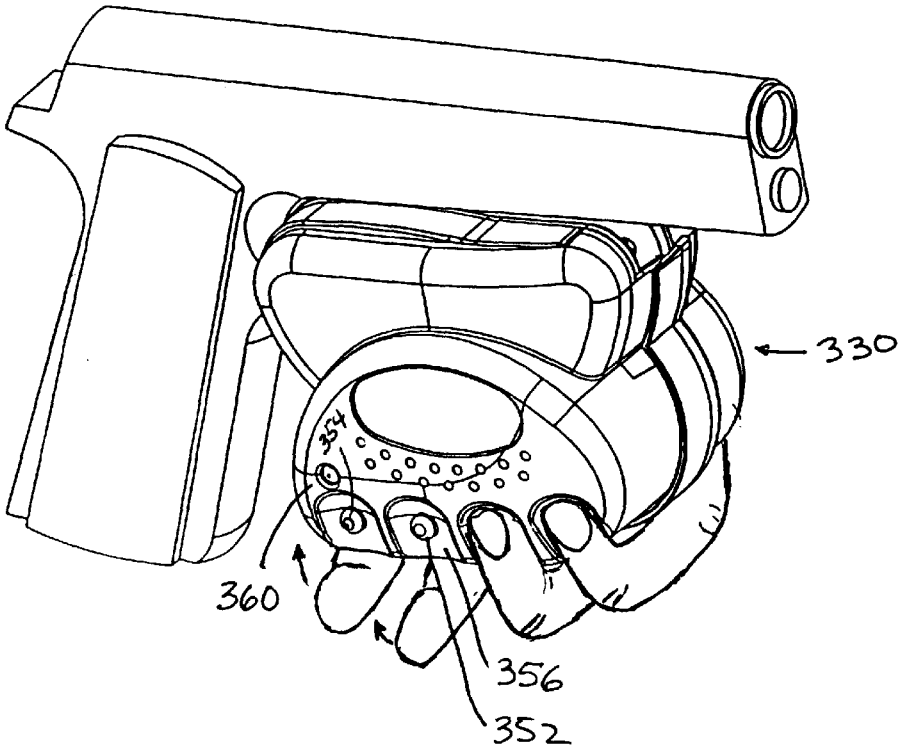
FIG. 17 is a perspective view of the third alternate embodiment secured to the firearm and illustrating the keypad in accordance with the invention.
Figure 18:
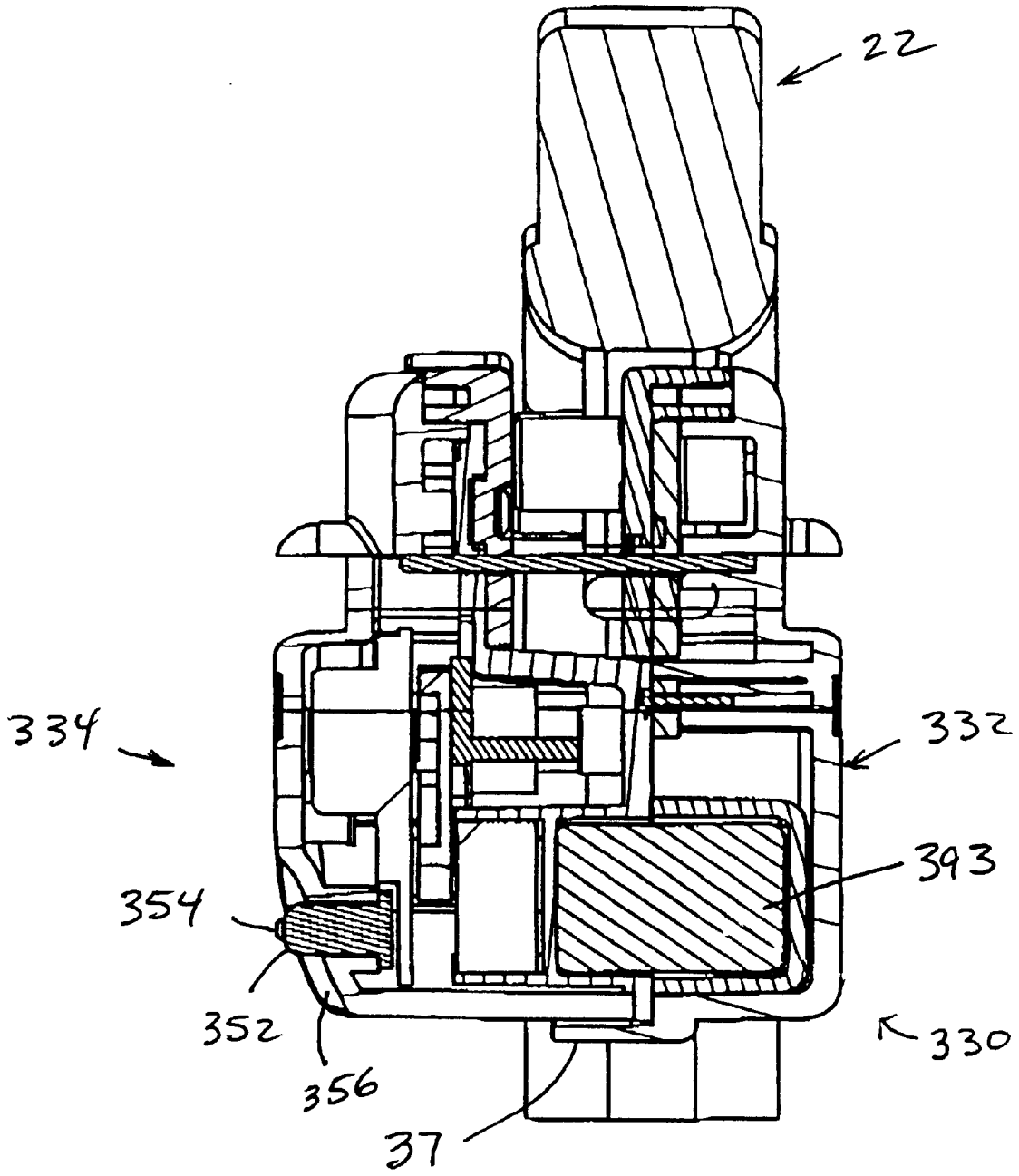
FIG. 18 is a sectional view of the firearm safety device shown in FIG. 17 illustrating the overlapping lip in accordance with the invention.

Referring now to FIGS. 16–18 a third alternate embodiment of the firearm safety device is shown generally at 330. The firearm safety device 330 is similar to the firearm safety device 30 described above in many respects, with like components numbered using the same reference numerals.

The firearm safety device 330 includes a first assembly 332 similar in many respects to the first assembly 32, 232 described above, and a second assembly 334. The second assembly 334 includes an actuator, such as an electric motor 388. The motor 388 includes a keyed shaft 392 received in cam 84 in a similar manner as the keyed lock post 92 described above. The electric motor 388 may be any suitable known motor for moving shaft 392, cam 84 and thus pawls 81 between the first and second positions described above.

A battery 393 is disposed in one of the assemblies 332, 334. The battery may be any known battery or batteries suitable for powering electronic components. The battery 393 is not accessible when the two assemblies 332, 334 are secured together on the firearm. The overlapping lip 37 prevents access to the battery 393 and other internal components as described above when the safety device 330 is secured to the firearm.

The second assembly 334 includes an alarm 340 connected to the battery 393 for providing an audible warning of unauthorized use. The alarm 340 may be any suitable known electronic alarm. An optional motion detector 342 can also be connected to the alarm 340 for sounding the alarm 340 after sensing movement of the firearm 10, 22 above a predetermined threshold level. Preferably, movement of the firearm with the armed safety device mounted thereon initiates a delay or countdown and the alarm does not sound until the completion of the countdown as described below. The countdown enables an authorized user to disable the alarm after moving the firearm without sounding the alarm. The motion detector 342 may be any suitable known motion detector. A microprocessor (not shown) is preferably connected to both the alarm 340 and the motion detector 342 for receiving signals from the motion detector 342 and actuating the alarm 340. The microprocessor may be any suitable known microprocessor.

The second assembly 334 further includes a keypad 350 having keys 352. The keys 352 are electrically connected to the microprocessor with suitable electrical leads such that when depressed, each key 352 completes a circuit producing a signal recognized by the microprocessor indicating that the button has been depressed. The microprocessor is configured to store the sequence in which keys are pressed. Pressing the keys 352 in a proper sequence can lock or unlock the firearm safety device 330 in a manner similar to the key lock 88 described above.

The keys 352 are arranged in a single horizontal row which is approximately parallel to the firearm barrel when the safety device is secured to the firearm. The keypad 350 preferably includes four keys 352, with each key corresponding to a different finger of the operator's hand as shown in FIG. 17. Further, in accordance with the invention, a portion of the key sequence which is less than the entire lock/unlock key sequence will enable or disable the alarm. For example, a five-key sequence may be used to lock/unlock the firearm safety device 330, with the first four keys of the sequence enabling/disabling the alarm. The firearm safety device 330 will be locked/unlocked after the entire 5 key sequence is entered, but the alarm may be enabled or disabled without unlocking the lock. Alternatively, any other suitable number of keys, when pressed in proper sequence, may be used for locking/unlocking and enabling/disabling the lock.

An optional switch is disposed adjacent the pair of apertures 80 which receive the lock posts 38. The switch is closed when the lock posts 38 are inserted into the apertures 80 thereby indicating that the two assemblies are being secured together. Closure of the switch is communicated to the microprocessor which activates the actuator, such as for example the motor, automatically locking the two assemblies together. A delay may be used between the time the switch is closed and when the actuator is activated. The motion detector may also be enabled automatically unless a proper sequence is keyed in.

The keypad 350 also includes a plurality of finger positioning guides 356, with each guide corresponding to a separate key 352. The finger positioning guides 356 can be grooves or recesses for receiving the fingers, or alternatively they can be defined between raised portions. The finger positioning guides 356 provide a tactile reference to guide the operator's fingers into contact with each corresponding key. The finger positioning guides 356 preferably extend vertically from the bottom of the second assembly 334 to the keys 352 so that when the operator's hand is placed under the safety device 330, the fingers will cup the device and bend around into contact with the keys. In this manner, the operator can grasp the grip of the firearm, a pistol for example, aiming it, while using the other hand to unlock the firearm safety device. The single row of keys 352 provides a suitable solution to the well known problem requiring the quick and efficient removal of the safety device from the firearm.

One of the keys 352, preferably one of the end keys, includes a tactile reference 354. The tactile reference 354 can be a protrusion, such as a dimple, or a recess or any other suitable distinction which when felt indicates that this key is the reference key. The tactile reference 354 enables the user to identify that key using touch rather than sight, thereby providing a suitable reference or landmark for using the keypad 350 in the dark. Any suitable key 352 may include the tactile reference 354.

An LED 360 may also mounted to the second assembly 334 which is electrically connected to the microprocessor to indicate the state of the alarm. For example, it can blink to indicate that the alarm is enabled. The LED may also be used to indicate that the lock is locked.

The safety device preferably includes a low battery alert. When the battery power drops to a predetermined low level at which full function is still possible but performance may be compromised with continued use, the audible alarm will emit an intermittent sound, for example a chirp, for a predetermined period of time, for example five seconds every minute. The LED visual alert can also flash simultaneously with the chirping of the audible alarm. Normal operation of the LED and the audible alarm are not affected by the low-battery alert condition.

The safety device can also include a low battery shutdown function which ceases all functions when the battery power drops to a predetermined low level. The LED will flash periodically, for example every 30 seconds, to indicate the low battery shutdown condition. Preferably, enough reserve power will be still available to awaken the processor when moved and energize the motor when the correct key sequence is entered.

When the alarm is enabled, the motion sensor 342 will sense the movement of the device if the firearm is moved somewhat abruptly. If the firearm is moved only a small amount, such as for example, by a person bumping the dresser in which the firearm is stored, the alarm will not be actuated.

Actuation of the alarm 340 sounds the alarm continuously during a first time interval for example for about 5 minutes. After which, the alarm sounds intermittently to conserve power. Therefore, after sounding continuously during the first time interval, the alarm ceases during a second time interval, of for example about 30 minutes, and then sounds for a third time interval of approximately 10–15 seconds. The second and third time intervals are then repeated sounding the alarm intermittently. Sounding the alarm intermittently for short periods of time after the initial continuous alarm allows the owner to be notified even if the owner was not present when the alarm was initially activated. Furthermore, this alarm scheme saves power. The first, second and third time intervals may be any suitable time periods with the third time interval being shorter than the first time interval.

The microprocessor includes memory for storing two different code sequences, an eight-step sequence which is factory programmed and cannot be erased or changed, and a five-step secret-sequence which is programmed by the authorized user via the keypad. After installing the battery, the owner can program a secret sequence when the firearm safety device 330 is in the unlocked, unalarmed state. The factory pre-programmed sequence is pressed first, After which the secret sequence may be programmed. The secret sequence may be required to be input again for verification.

The microprocessor can also store a factory programmed (default) alarm delay. The delay is the time between when the motion detector senses that the firearm is moved and the actuation of the alarm. This delay enables the user to press the proper key sequence to disable the alarm after picking up the firearm before the alarm sounds. The same or different delay is also used to set the length of time between when the sequence is pressed for enabling the alarm and when the alarm is actually enabled. This permits the authorized user sufficient time to store the firearm after locking and enabling the alarm. The factory default delay is preferably about 10 seconds, although any suitable time period can be used.

However, the delay time mayn be changed by pressing one of the keys 352 after the secret sequence is programmed. Each key represents a different delay time, such as for example: key 1 enabling a 5 second delay, key 2 enabling a 10 second delay, key 3 enabling a 15 second delay, and key 4 enabling a 20 second delay, or any other suitable delays.

The invention has been described with reference to a preferred initial embodiment. Obviously, alterations and modifications will occur to others upon a reading and understanding of this specification. It is intended to include all such modifications and alternations insofar as they come within the scope of the appended claims or the equivalents thereof.

What is claimed is:

1. A firearm safety device for a firearm having a trigger and a trigger guard, said firearm safety device comprising:

a first assembly adapted to be disposed adjacent a first side of the trigger guard to prevent access to and actuation of the trigger and including a pair of lock posts extending from said first assembly; and a second assembly adapted to be disposed adjacent a second side of the trigger guard and joined together with said first assembly to prevent access to and actuation of the trigger, said second assembly including pawls, said pawls being movable to two positions including a locked position in which said pawls engage with said pair of lock posts for securing said first and second assemblies together and an unlocked position in which said pawls do not engage with said pair of lock posts for allowing separation of said first and second assemblies from each other and from the firearm;

a rotatable cam disposed between said pawls, wherein rotation of said cam moves said pawls into said locked and unlocked positions;

a lock for enabling rotation of said cam.

2. The firearm safety device defined in claim 1 further including a spring abutting said pawls for biasing said pawls towards said cam.

3. The firearm safety device defined in claim 1 wherein said lock posts extend from said first assembly outside of the trigger guard when said first assembly is disposed adjacent the first side of the trigger guard.

4. The firearm safety device defined in claim 3 wherein said first and second assemblies enclose said lock posts when joined together so that said lock posts do not form external surfaces of said first and second assemblies.

5. The firearm safety device defined in claim 1 further including an actuator for rotating said cam thereby moving said pawls to said locked and unlocked positions.

6. The firearm safety device defined in claim 5 wherein said actuator is moved by a key inserted into said lock.

7. The firearm safety device defined in claim 5 wherein said actuator is a motor.

8. The firearm safety device defined in claim 1 wherein said first and second assemblies can be joined together on the firearm with said pawls in the unlocked position.

9. The firearm safety device defined in claim 1 wherein said lock posts include teeth and said pawls include teeth for meshing with said lock post teeth in the locked position.

10. The firearm safety device defined in claim 9 wherein said lock post teeth and said pawl teeth are shaped to allow said first and second assemblies to be joined together on the firearm with said pawls in the locked position.

11. The firearm safety device defined in claim 9 wherein said lock post teeth and said pawl teeth ratchet past each other as said first and second assemblies are brought together to tighten the grip formed between said first and second assemblies and the trigger guard.

12. The firearm safety device defined in claim 1 wherein said lock includes a keypad having keys which unlock said lock for enabling rotation of said cam when pressed in a proper sequence.

* * * * *